US006739816B1

(12) United States Patent
Schuder et al.

(10) Patent No.: US 6,739,816 B1
(45) Date of Patent: May 25, 2004

(54) SYSTEMS AND METHODS OF ATTACHING A COVER TO A TEXT BODY

(75) Inventors: Raymond G. Schuder, Menlo Park, CA (US); John P. Ertel, Portola Valley, CA (US); Robert L. Cobene, Santa Clara, CA (US); Steven W. Trovinger, Los Altos, CA (US); Ross R. Allen, Belmont, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 53 days.

(21) Appl. No.: 09/721,549

(22) Filed: Nov. 24, 2000

(51) Int. Cl.[7] ..... B42C 11/00

(52) U.S. Cl. ..... 412/4; 156/1; 281/15.1; 281/21.1; 412/1; 412/19; 412/36

(58) Field of Search ..... 412/1, 3, 4, 8, 412/19, 36, 37; 156/1; 281/15.1, 21.1, 29; 206/389, 411

(56) References Cited

U.S. PATENT DOCUMENTS

| | | | | |
|---|---|---|---|---|
| 4,272,573 A | * | 6/1981 | Ewald et al. | 428/40.8 |
| 4,289,330 A | | 9/1981 | Wiermanski | |
| 4,299,410 A | | 11/1981 | Jukola | |
| 4,622,357 A | * | 11/1986 | Tsuchida et al. | 524/270 |
| 4,911,475 A | | 3/1990 | Lerman | |
| 5,028,193 A | | 7/1991 | Misicka | |
| 5,129,772 A | | 7/1992 | Slautterback | |
| 5,152,654 A | | 10/1992 | Luhman et al. | |
| 5,156,510 A | * | 10/1992 | Uehara | 412/8 |
| 5,261,769 A | | 11/1993 | Leclerc | |
| 5,271,794 A | | 12/1993 | Jarrell et al. | |
| 5,316,424 A | | 5/1994 | Luhman et al. | |
| 5,322,709 A | * | 6/1994 | Lulla et al. | 427/208.2 |
| 5,346,350 A | | 9/1994 | Luhman et al. | |
| 5,437,476 A | | 8/1995 | Hutchinson | |
| 5,536,044 A | | 7/1996 | Luhman et al. | |
| 5,605,425 A | | 2/1997 | Schaefer | |
| 5,632,853 A | | 5/1997 | Montandon, Jr. et al. | |
| 5,693,142 A | | 12/1997 | Pedigrew et al. | |
| 5,726,256 A | * | 3/1998 | Benson et al. | 525/477 |
| 5,770,283 A | * | 6/1998 | Gosselin et al. | 428/35.7 |
| 5,779,423 A | | 7/1998 | Bermingham | |
| 5,981,009 A | * | 11/1999 | Iacono et al. | 428/40.1 |
| 6,136,119 A | * | 10/2000 | Columbus et al. | 156/152 |
| 6,142,721 A | * | 11/2000 | Marsh | 281/21.1 |
| 6,193,458 B1 | * | 2/2001 | Marsh | 412/1 |

FOREIGN PATENT DOCUMENTS

| | | |
|---|---|---|
| EP | 0695645 | 2/1996 |
| EP | 0656308 | 1/1998 |
| JP | 06048065 | 2/1994 |
| JP | 08324153 | 12/1996 |
| JP | 11170727 | 6/1999 |
| JP | 11245538 | 9/1999 |
| WO | WO 99/38707 | 8/1999 |

* cited by examiner

*Primary Examiner*—Monica S. Carter

(57) ABSTRACT

Systems and methods for attaching a cover to a text body to create bound documents with floating and attached spines are described. In some embodiments, a solid pressure sensitive adhesive film is applied between a cover and the side hinge areas of a text body, and a cover is bound to the side hinge areas of the text body with pressure. A solid pressure sensitive adhesive tape may be dispensed from an adhesive dispenser that includes a plug-in cartridge housing, a supply spool, and a take-up spool. In other embodiments, an adhesive sheet that includes a hot melt adhesive film and a backing is applied to the text body, with the hot melt adhesive film in contact with the side hinge areas and the spine of the text body. The hot melt adhesive is exposed in areas corresponding to the side hinge areas of the text body for attaching the cover to the text body. In one embodiment, an adhesive sheet includes a hot melt adhesive film and a backing layer that is attached to the hot melt adhesive film and has one or more slits extending in a substantially longitudinal direction. The slitted backing layer is configured to expose the hot melt adhesive upon stretching of the backing layer in a direction substantially orthogonal to the longitudinal direction.

18 Claims, 6 Drawing Sheets

SYSTEMS AND METHODS OF ATTACHING A COVER TO A TEXT BODY

TECHNICAL FIELD

This invention relates to systems and methods of attaching a cover to a text body.

BACKGROUND

Today, a variety of different bookbinding systems can deliver professionally bound documents, including books, manuals, publications, annual reports, newsletters, business plans, and brochures. A bookbinding system generally may be classified as a-commercial (or trade) bookbinding system that is designed for in-line manufacturing of high quality volume runs or an in-house (or office) bookbinding system designed for short "on-demand" runs. Commercial bookbinding systems generally provide a wide variety of binding capabilities, but require large production runs (e.g., on the order of thousands of bindings) to offset the set-up cost of each production run and to support the necessary investment in expensive in-line production equipment. Office bookbinding systems, on the other hand, generally involve manual intervention and provide relatively few binding capabilities, but are significantly less expensive to set up and operate than commercial bookbinding systems, even for short on-demand production runs of only a few books.

In general, a bookbinding system collects a plurality of sheets (or pages) into a text body (or book block) that includes a spine and two side hinge areas. The bookbinding system applies an adhesive to the text body spine to bind the sheets together. A cover may be attached to the bound text body by applying an adhesive to the side hinge areas or the spine of the text body, or both. The cover of a typical commercial soft cover book generally is attached to the text spine. The covers of hardcover books and some soft cover "lay flat" books, on the other hand, typically are not attached to the text body spines (i.e., the spines are "floating").

Many different systems have been proposed for making books with attached spines. For example, U.S. Pat. No. 5,346,350 discloses an apparatus for binding sheets that includes a pair of clamping plates that hold the sheets during binding after an aligning plate has aligned the sheet edges. A heating platen heats and melts a backless solid hot melt adhesive that is placed along the sheet edges. The hot melt adhesive binds the sheets together at the spinal area. The hot melt adhesive also may be used to attach a preformed book cover to the text body spine.

Similarly, many different systems have been proposed for making books with floating spines.

For example, U.S. Pat. No. 5,779,423 discloses a paperback bookbinding scheme in which the text body is bound by a hot melt adhesive that is attached to a coating (or laminating) film that prevents the text body from attaching to the cover in the spinal area of the cover. In this way, the book is free to open with a floating spine. In one embodiment, a molten synthetic resin of pressure-sensitive glue (or adhesive) is applied to the spine and side hinge areas of the text body. A non-adhering coating is applied to a region of the cover that extends over the spinal area between a pair of hinge score lines. The non-adhering coating is formed from a quick-drying liquid carrier and a powdered material. Glue strips are applied to the cover along lines just beyond the score lines. The text body is attached to the cover by the glue strips and is attached to the non-adhering coating by the pressure sensitive adhesive. When the book is opened, the non-adhering coating allows the text body to move independently of the spinal portion of the cover. In another embodiment, a clear plastic film is laminated to the side hinge areas of the cover, but is unattached to the cover in the spinal area where a non-adhering coating previously was applied. The text body is attached to the laminating film by hot melt glue strips. As a result, when the book is opened, the text body is free to move independently of the spinal area of the cover.

U.S. Pat. No. 5,261,769 discloses a paperback bookbinding scheme in which the text body is bound by an adhesive. A crash layer (or crinkle paper layer) is attached by a glue adhesive to one or both side hinge areas of the cover, but not to the spinal area of the cover. The crash layer then is attached to the text body by a glue adhesive. Thus, the cover is not attached to the crash layer, allowing the book to open with a floating spine.

U.S. Pat. No. 4,299,410 discloses a paperback bookbinding scheme in which the text body is bound by a flexible support layer (e.g., gauze, cloth, crepe strip or ribbon). The cover is attached to the text body by two adhesive glue strips that extend along the front and back hinge areas.

Japanese Patent Publication No. 8324153 discloses a bookbinding scheme in which a tape is laminated to the front and rear of a text body, but not to the spine area of the text body. The entire extent of the tape is bonded to the cover. When the book is opened, the text body is allowed to move independently of the tape in the area of the book spine.

Japanese Patent Publication No. 6048065 discloses a bookbinding scheme in which a hot melt adhesive is applied to the spine and side hinge areas of a text body. A "paste-dissolving liquid" is applied to the spinal area to prevent the text body from adhering to the cover. As a result, when the cover is pressed against the text body, the cover attaches only to the side hinge areas of the text body.

Still other bookbinding systems have been proposed.

SUMMARY

The invention features novel systems and methods for attaching a cover to a text body to create bound documents with floating and attached spines.

In one aspect, the invention features a bookbinding method in accordance with which two or more sheets are bound into a text body having an exposed spine bounded by two exposed side hinge areas. A solid pressure sensitive adhesive film is applied between a cover and the side hinge areas of the text body. The cover is bound to the side hinge areas of the text body by applying pressure to the cover.

Embodiments in accordance with this aspect of the invention may include one or more of the following features.

The solid pressure sensitive adhesive film may be applied to the cover before contacting the side hinge areas of the text body. The solid pressure sensitive adhesive film may be applied to the cover as two strips that are spaced apart by a width dimension that is at least as wide as the exposed spine of the text body.

In some embodiments, the solid pressure sensitive adhesive film is applied between the cover and the exposed spine of the text body. The solid pressure sensitive adhesive film may be applied as a single continuous strip with a width dimension that is wider than the exposed spine of the text body. Alternatively, the solid pressure sensitive adhesive film may be applied in a series of multiple strips over an area corresponding to the side hinge areas and the exposed spine of the text body.

In one embodiment, the solid pressure sensitive adhesive film comprises a pressure sensitive adhesive composition laminated to a hot melt adhesive film. In this embodiment, two or more sheets are bound into the text body by applying the solid pressure sensitive adhesive film with the hot melt adhesive film in contact with the side hinge areas and the exposed spine of the text body. The hot melt adhesive film is melted to bind the two or more sheets to the text body. The cover is bound to the side hinge areas of the text body by disposing the cover over the text body and applying pressure to the cover to activate the pressure sensitive adhesive composition.

In another aspect, the invention features a bookbinding system that includes a sheet binder, an adhesive dispenser, and a cover binder. The sheet binder is configured to bind two or more sheets into a text body having an exposed spine that is bounded by two exposed side hinge areas. The adhesive dispenser is configured to apply a solid pressure sensitive adhesive film between a cover and the side hinge areas of the text body. The cover binder is configured to bind the cover to the side hinge areas of the text body by applying pressure to the cover.

Embodiments in accordance with this aspect of the invention may include one or more of the following features.

The adhesive dispenser preferably is configured to apply a solid pressure sensitive adhesive film to the cover in a series of spaced-apart strips. The adhesive dispenser preferably comprises a plug-in cartridge housing. The adhesive dispenser preferably comprises a supply spool that is disposed within the plug-in cartridge housing and is configured to support a roll of pressure sensitive adhesive tape formed from a solid pressure sensitive adhesive film disposed on a carrier ribbon. The adhesive dispenser preferably also comprises a take-up spool that is disposed within the plug-in cartridge housing and is configured to reel-in spent carrier ribbon.

In another aspect, the invention features a bookbinding method in accordance with which two or more sheets are collected into a text body having an exposed spine bounded by two exposed side hinge areas. An adhesive sheet comprising a hot melt adhesive film and a backing is applied to the text body with the hot melt adhesive film in contact with the side hinge areas and the spine of the text body. The hot melt adhesive is exposed in areas corresponding to the side hinge areas of the text body. A cover is disposed over the text body. The hot melt adhesive is melted to bind the two or more sheets at the text body spine and to bind the cover to the side hinge areas of the text body.

Embodiments in accordance with this aspect of the invention may include one or more of the following features.

The backing may include one or more slits, and the hot melt adhesive may be exposed by stretching the backing in the side hinge areas to expose the hot melt adhesive through the slits. In another embodiment, the hot melt adhesive may be exposed by removing the backing in areas corresponding to the side hinge areas of the text body. In another embodiment, the hot melt adhesive is exposed by folding edges of the adhesive sheet back over at least a portion of each of the side hinge areas.

In another aspect, the invention features an adhesive sheet comprising a hot melt adhesive film, and a backing layer attached to the hot melt adhesive film and having one or more slits extending in a substantially longitudinal direction and configured to expose the hot melt adhesive upon stretching of the backing layer in a direction substantially orthogonal to the longitudinal direction.

In some embodiments, the backing comprises a staggered array of slits.

Other features and advantages of the invention will become apparent from the following description, including the drawings and the claims.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

Figure 1:
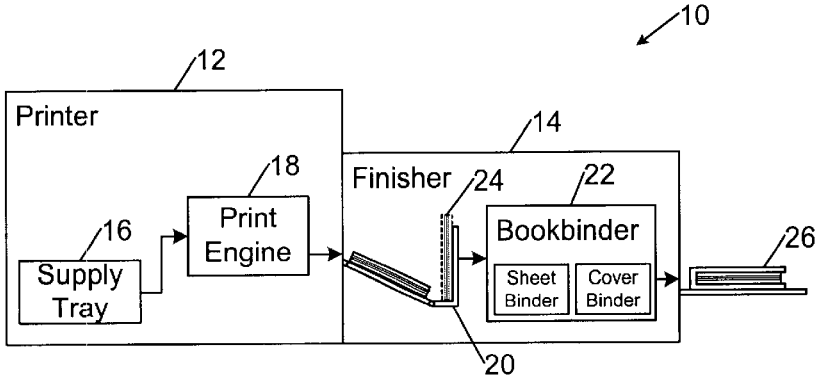
FIG. 1 is a diagrammatic side view of a bookbinding system.

Referring to FIG. 1, in one embodiment, a bookbinding system 10 includes a printer 12 and a finisher 14. Bookbinding system 10 may be implemented as a desktop or office bookmaking system designed to satisfy on-demand bookbinding needs. Printer 12 may be a conventional printer (e.g., a LaserJet® printer available from Hewlett-Packard Company of Palo Alto, Calif., U.S.A.) that includes a supply tray 16 that is configured to hold a plurality of sheets (e.g., paper sheets), and a print engine 18 that is configured to apply markings onto the sheets received from supply tray 16. Finisher 14 includes a sheet collector 20 and a bookbinder 22. Bookbinder 22 includes a sheet binder that is configured to bind the text body sheets to one another, and a cover binder that is configured to attach a cover to the bound text body. In operation, sheets are fed from supply tray 16 to print engine 18, which prints text, pictures, graphics, images and other patterns onto the sheets. The printed sheets are fed to sheet collector 20, which collects and aligns the sheets into a text body 24 with an exposed spine bounded by two exposed side hinge areas. The text body 24 is conveyed to bookbinder 22. The sheet binder binds the sheets of text body 24, and the cover binder attaches a cover to the bound text body to produce a bound book 26 with a floating or attached spine.

Figure 2:
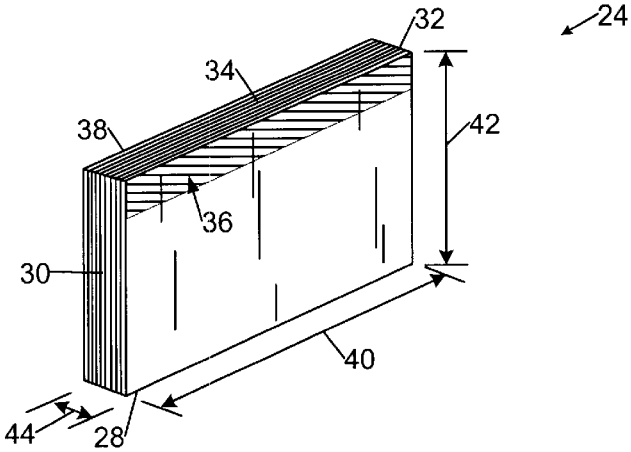
FIG. 2 is a diagrammatic perspective view of a text body formed by collecting and aligning a plurality of sheets.
Figure 3:
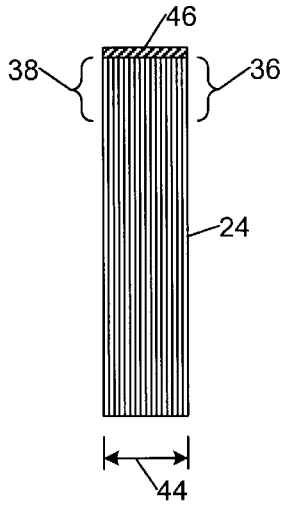
FIG. 3 is a diagrammatic end view of the text body of FIG. 2 bound by a hot melt adhesive applied to the text body spine.

As shown in FIGS. 2 and 3, text body 24 includes a plurality of sheets that are registered and aligned with respect to two datum edges. The sheets preferably are aligned with reference to a front end 28 and one of two sides 30, 32 so that variations in sheet dimensions are accommodated in a spinal area (or spine) 34, which is located opposite to front end 28. Spine 34 is bounded by two side hinge areas 36, 38. Text body 24 may be characterized by a height dimension 40, a width dimension 42, and a thickness dimension 44. In one embodiment, height dimension 40 and thickness dimension 44 are measured. A hot melt adhesive 46 is pre-formed, applied to the text body spine 34, and heated to a temperature at or above the melting temperature of the adhesive. The melted adhesive conforms to the exposed surface features of spinal area 34 and flows into spaces between the edges of the sheets by capillary action. Upon cooling, hot melt adhesive 46 re-solidifies and binds the sheets into a bound text body. A variety of different hot melt adhesive compositions may be used to bind the text body sheets, including a conventional paper-backed hot melt sheet adhesive that may be dispensed from a roll.

Figure 4A:
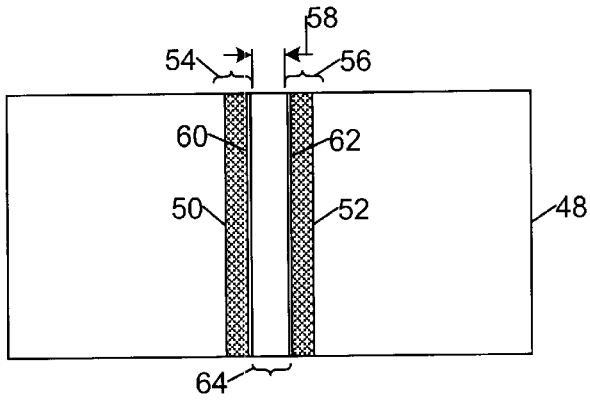
FIG. 4A is a diagrammatic front view of a cover with two strips of pressure sensitive adhesive applied to areas corresponding to the side hinge areas of the bound text body of FIG. 3.
Figure 4B:
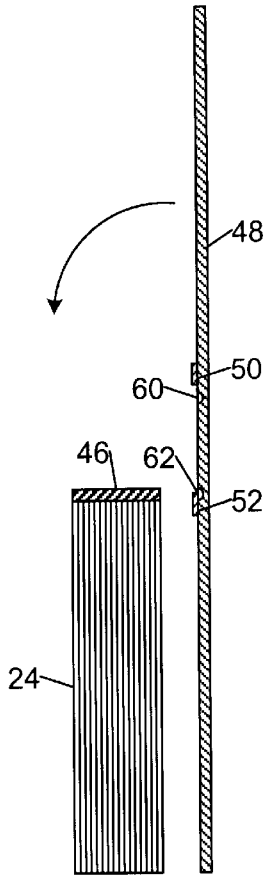
FIG. 4B is a diagrammatic end view of the cover of FIG. 4A being folded over the bound text body of FIG. 3.
Figure 4C:
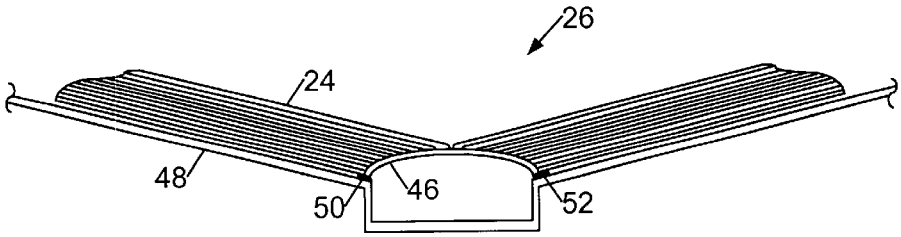
FIG. 4C is a diagrammatic end view of an open bound book with a floating spine formed by attaching the cover of FIG. 4A to the bound text body of FIG. 3.

Referring to FIGS. 4A–4C, in one embodiment, a solid pressure sensitive adhesive film is applied to a cover 48 as two strips 50, 52 in cover areas 54, 56 that correspond to side hinge areas 36, 38 of text body 24. Pressure sensitive adhesive strips 50, 52 are spaced apart by a width dimension 58 that is at least as wide as the thickness dimension 44 of text body spine 34. As shown in FIG. 4B, cover 48 is aligned with respect to the same datum edges used to align the sheets of text body 24, cut to size, and folded over the bound text body 24. Cover 48 preferably is scored along a pair of score lines 60, 62 to allow cover 48 preferentially to fold over spinal area 34 of text body 24. Pressure is applied to cover areas 54,56 to activate pressure sensitive adhesive strips 50, 52 and, thereby, attach cover 48 to text body 24. As shown in FIG. 4C, the resulting perfectly bound book 26 has a floating spine that enables the book 26 to lay flat when opened.

Figure 5:
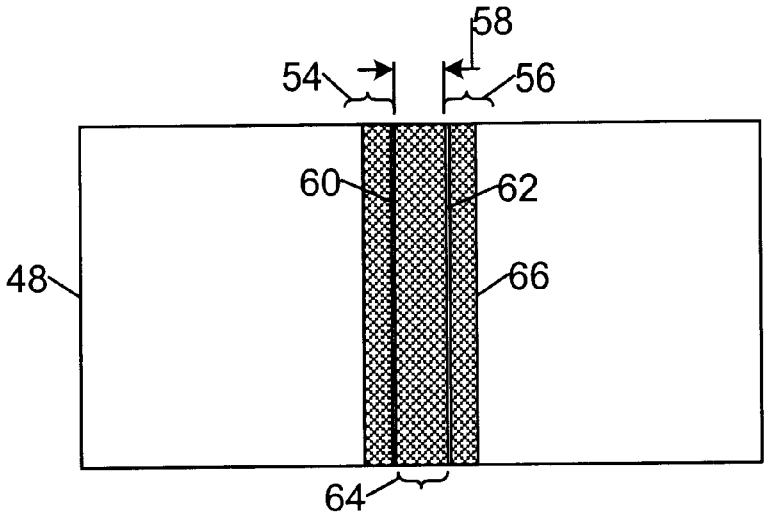
FIG. 5 is a diagrammatic front view of a cover with a single strip of pressure sensitive adhesive applied to an area corresponding to the spine and side hinge areas of the bound text body of FIG. 3.
Figure 6:
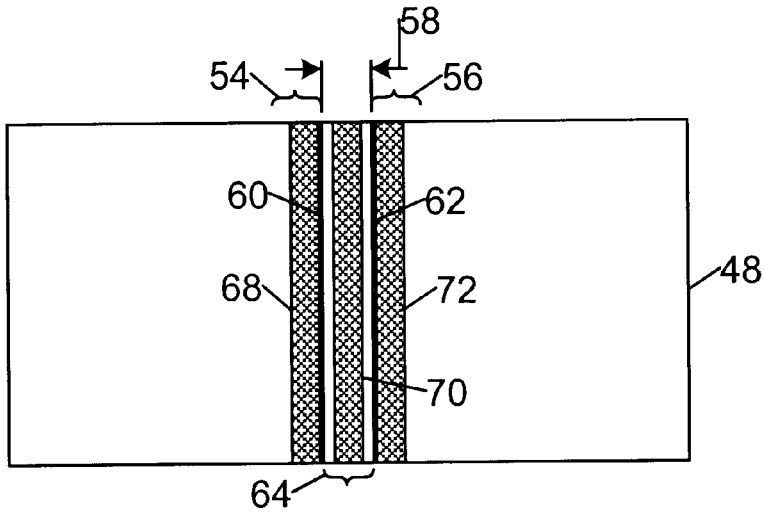
FIG. 6 is a diagrammatic front view of a cover with multiple strips of pressure sensitive adhesive applied to an area corresponding to the spine and side hinge areas of the bound text body of FIG. 3.

As shown in FIGS. 5 and 6, text body 24 may be bound to cover 48 with an attached spine construction by applying a solid pressure sensitive adhesive film to a cover area 64 that corresponds to text body spine 34. The solid pressure sensitive adhesive film may be applied as a single continuous strip 66 over cover areas 54, 56, and 64 (FIG. 5), or in a series of multiple strips 68, 70, 72 over cover areas 54, 56, and 64 (FIG. 6).

As used herein, "pressure sensitive adhesives" refer to a class of adhesive compositions that are applied with pressure and generally do not undergo a liquid to solid transition in order to hold materials together. Pressure sensitive adhesives may be solvent-free natural or synthetic resins characterized by the rapid wetting of a surface to form an adhesive bond upon contact with the surface under pressure.

Figure 7A:
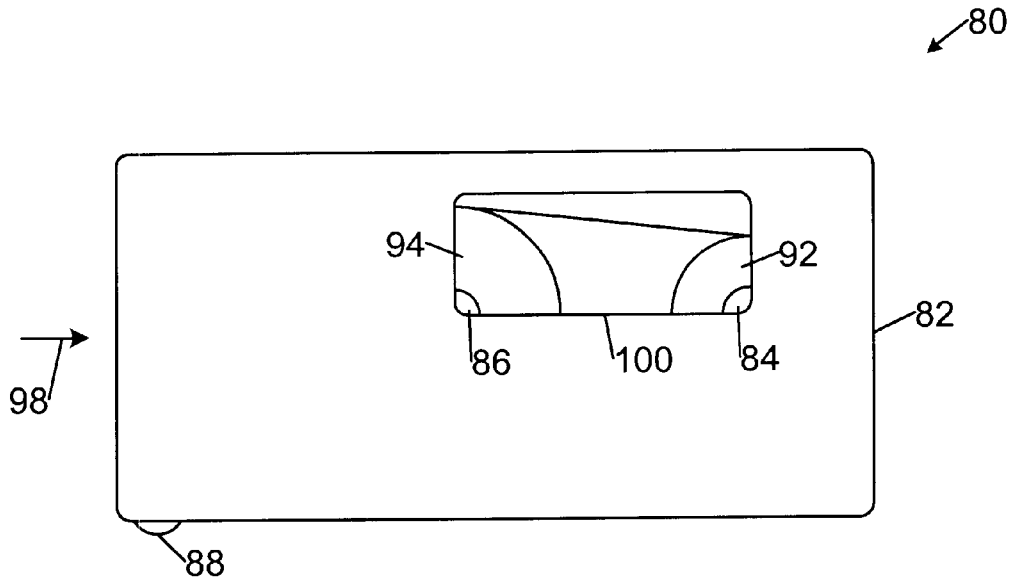
FIG. 7A is a diagrammatic side view of a plug-in adhesive dispenser for applying solid pressure sensitive adhesive film to a book cover.
Figure 7B:
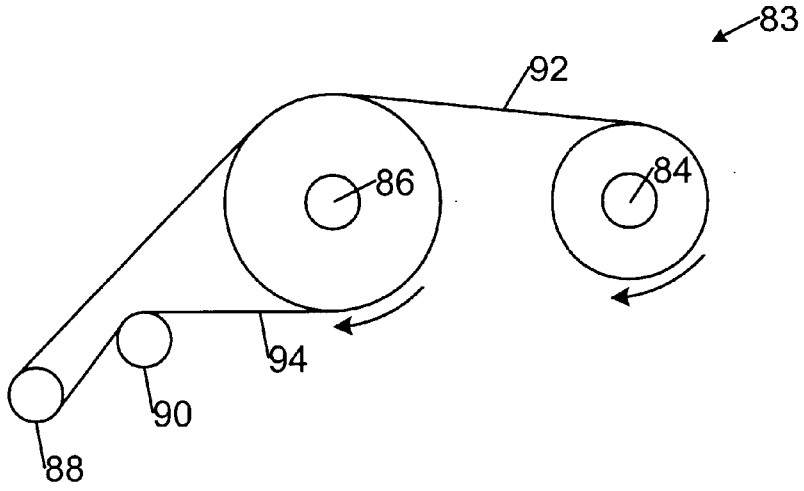
FIG. 7B is a diagrammatic side view of an adhesive dispensing mechanism of the plug-in adhesive dispenser of FIG. 7A, including a supply spool supporting a roll of a sheet adhesive formed from a solid pressure sensitive adhesive film composition disposed on a carrier ribbon, and a take-up spool configured to reel-in spent carrier ribbon.

Referring to FIGS. 7A and 7B, in one embodiment, pressure sensitive adhesive strips may be applied to cover 48 by an adhesive dispenser 80 that includes a plug-in cartridge housing 82 and an adhesive dispensing mechanism 83. Cartridge housing 82 may plug into a corresponding receptacle in bookbinder 22 of finisher 14. The receptacle is located on a positioning mechanism that draws adhesive dispenser 80 across selected areas of cover 48. Adhesive dispensing mechanism 83 includes a take-up spool 84, a supply spool 86, an application roller 88, and a guide roller 90. Supply spool 86 is disposed within plug-in cartridge housing 82 and is configured to support a roll of sheet adhesive (or adhesive tape) 94 that includes a pressure sensitive adhesive composition disposed on a carrier ribbon 92. Take-up spool 84 is configured to reel-in spent carrier ribbon 92. In operation, application roller 88 is placed against a surface of cover 48. Take-up spool 84 and supply spool 86 are coupled by a gear coupling mechanism. The gear coupling mechanism is configured so that take-up spool 84 reels in spent carrier ribbon 92 at a speed that is greater than the feed speed of supply spool 86, even when the winding diameter of carrier ribbon 92 on take-up spool 84 becomes greater than the winding diameter of adhesive tape roll 94. Excessive tension between take-up spool 84 and supply spool 86 is relieved by a conventional clutch mechanism between the gears of take-up spool 84 and supply spool 86. As adhesive dispenser 80 is drawn across the cover surface in a direction indicated by arrow 98, the tack properties of the pressure sensitive adhesive between application roller 88 and the cover surface releases a film of pressure sensitive adhesive from carrier ribbon 94 onto the cover surface.

Multiple adhesive dispensers 80 may be stacked and loaded into bookbinder 22. Cartridge housing 82 of each adhesive dispenser includes a window 100 through which an optical sensor may detect when the supply of adhesive tape 92 is exhausted. Bookbinder 22 may be configured to replace an exhausted adhesive dispenser automatically based upon a signal received from the optical sensor. After each of the loaded adhesive dispensers has been exhausted, bookbinder 22 may display a notice indicating that another adhesive dispenser stack should be loaded into the system.

Other embodiments are within the scope of the claims. For example, the same sheet adhesive may be used both to bind the text body sheets and to bind the cover to the text body to produce bound books with floating and attached spines.

Figure 8:
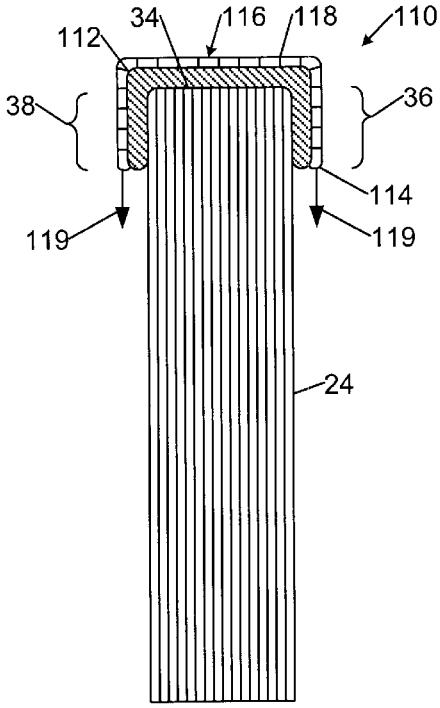
FIG. 8 is a diagrammatic end view of the text body of FIG. 2 bound by a hot melt adhesive with a slitted backing layer.
Figure 9A:
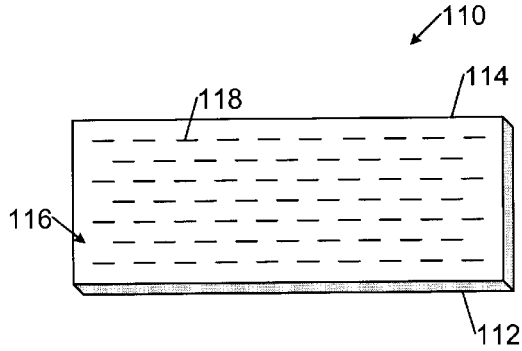
FIG. 9A is a diagrammatic top view of the slitted backing layer of FIG. 8 in a relaxed state.
Figure 9B:
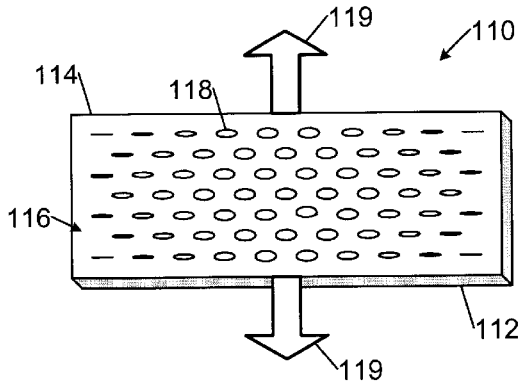
FIG. 9B is a diagrammatic top view of the slitted backing layer of FIG. 8 in a stretched state.

Referring to FIGS. 8, 9A and 9B, in one embodiment, an adhesive sheet 110 that includes a hot melt adhesive film 112 and a slitted backing layer 114 may be used both to bind the text body sheets and to bind cover 48 to text body 24.

Backing layer 114 may be formed from paper with a non-stick, exposed surface 116. In one embodiment, backing layer 114 includes a staggered array of slits 118. In operation, adhesive 110 may be cut to size and placed over spine 34 and side hinge areas 36, 38 of text body 24. Hot melt adhesive film 112 then is heated to a temperature at or above the melting temperature of the adhesive. The melted adhesive conforms to the exposed surface features of spinal area 34 and flows into spaces between the edges of the sheets. Before hot melt adhesive 112 has re-solidified, the portion of backing layer 114 located above spinal area 34 may be clamped in position, while the portions of backing layer 114 disposed over side hinge areas 36, 38 may be pulled downward in a direction away from spinal area 34. As shown in FIG. 9B, the application of such a force 119 across the side hinge area portions of backing layer 114 opens each of the slits 118 to expose hot melt adhesive 112. Cover 48 may then be folded over text body 24 and pressed into contact with the hot melt adhesive that is exposed through slits 118. Upon cooling, hot melt adhesive film 112 re-solidifies to bind the text body sheets to one another and cover 48 to text body 24. The resulting perfectly bound book 26 has a floating spine that enables the book to lay flat when opened.

Figure 10:
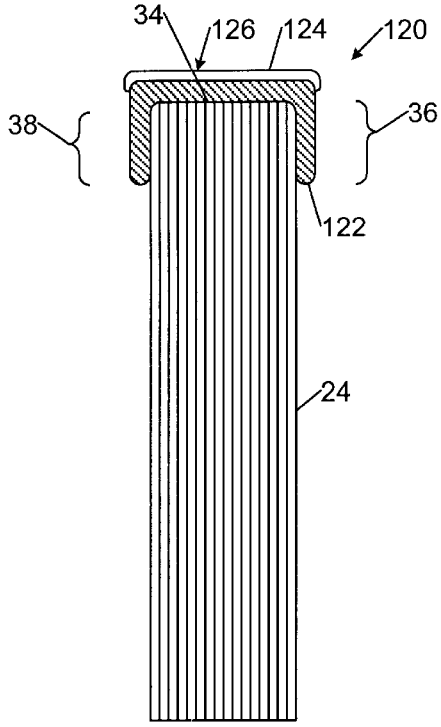
FIG. 10 is a diagrammatic end view of the text body of FIG. 2 bound by a backed hot melt adhesive with the backing layer removed in areas corresponding to the side hinge areas of the text body.

Referring to FIG. 10, in another embodiment, an adhesive sheet 120 that includes a hot melt adhesive film 122 and a backing layer 124 may be used both to bind the text body sheets and to bind cover 48 to text body 24. Backing layer 124 may be formed from paper with a non-stick, exposed surface 126. In operation, adhesive sheet 120 may be cut to size and placed over spine 34 and side hinge areas 36, 38 of text body 24. The portion of backing layer 124 located above spinal area 34 may be clamped in position, while the portions of backing layer 124 disposed over side hinge areas 36, 38 may be removed. Hot melt adhesive film 122 then is heated to a temperature at or above the melting temperature of the adhesive. The melted adhesive conforms to the exposed surface features of spinal area 34 and flows into spaces between the edges of the sheets. Before hot melt adhesive 122 has re-solidified, cover 48 may be folded over text body 24. Upon cooling, hot melt adhesive film 122 re-solidifies to bind the sheets to one another and cover 48 to text body 24. The resulting perfectly bound book 26 has a floating spine that enables the book to lay flat when opened.

Figure 11:
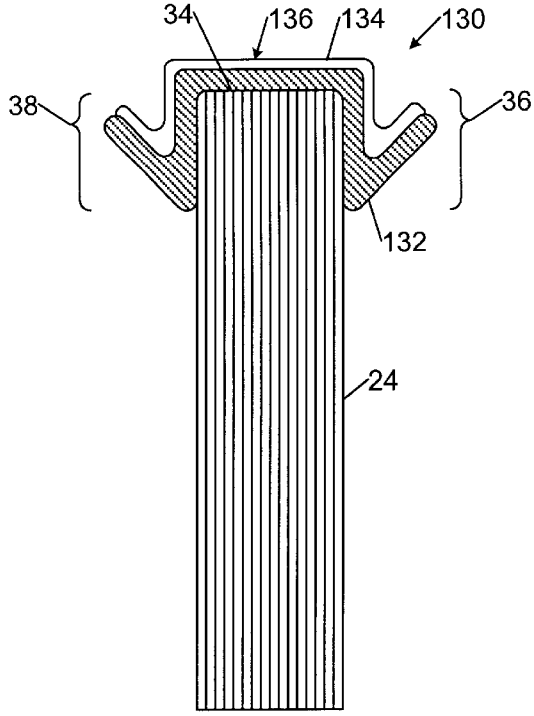
FIG. 11 is a diagrammatic end view of the text body of FIG. 2 bound by a backed hot melt adhesive with edges folded back over at least a portion of each of the side hinge areas of the text body.

Referring to FIG. 11, in another embodiment, an adhesive sheet 130 that includes a hot melt adhesive film 132 and a backing layer 134 may be used both to bind the text body sheets and to bind cover 48 to text body 24. Backing layer 134 may be formed from paper with a non-stick, exposed surface 136. In operation, adhesive sheet 130 may be cut to size and placed over spine 34 and side hinge areas 36, 38 of text body 24. The portion of backing layer 134 located above spinal area 34 may be clamped in position, while the portions of backing layer 134 disposed over side hinge areas 36, 38 may be folded back over at least a portion of each of the side hinge areas 36, 38. Hot melt adhesive film 132 then is heated to a temperature at or above the melting temperature of the adhesive. The melted adhesive conforms to the exposed surface features of spinal area 34 and flows into spaces between the edges of the sheets. Before hot melt adhesive 132 has re-solidified, cover 48 may be folded over text body 24. Upon cooling, hot melt adhesive film 132 re-solidifies to bind the sheets to one another and cover 48 to text body 24. The resulting perfectly bound book 26 has a floating spine that enables the book to lay flat when opened.

Figure 12A:
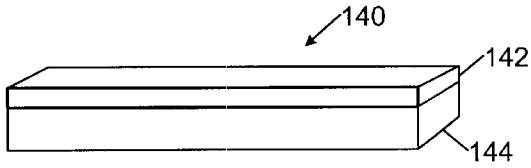
FIG. 12A is a diagrammatic perspective view of an adhesive sheet that includes a pressure sensitive adhesive composition that is laminated to a hot melt adhesive film.
Figure 12B:
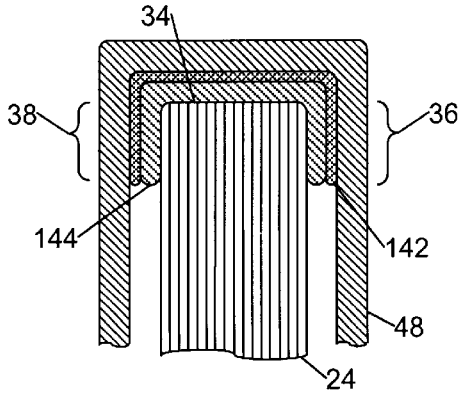
FIG. 12B is a diagrammatic partial end view of a cover attached to the text body of FIG. 2 by the adhesive sheet of FIG. 12A.

Referring to FIGS. 12A and 12B, in another embodiment, a sheet adhesive 140 includes a pressure sensitive adhesive composition 142 that is laminated to a hot melt adhesive film 144. Sheet adhesive 140 may be used both to bind the text body sheets and to bind cover 48 to text body 24. In operation, adhesive sheet 140 may be cut to size and placed over spine 34 and side hinge areas 36, 38 of text body 24. Hot melt adhesive film 144 then is heated to a temperature at or above the melting temperature of the adhesive. The melted adhesive conforms to the exposed surface features of spinal area 34 and flows into spaces between the edges of the sheets and over side hinge areas 36, 38. Upon cooling, hot melt adhesive film 144 re-solidifies to bind the sheets into a bound text body. Cover 48 may be folded over text body 24, and pressure may be applied to cover areas corresponding to the spine 34 and side hinge areas 36, 38 to activate pressure sensitive adhesive 142. The resulting bound book 26 has an attached spine.

In sum, the above-described embodiments incorporate novel systems and methods for attaching a cover to a text body to create bound documents with floating and attached spines in a manner that may improve the performance and cost-effectiveness of desktop and office on-demand book-binding systems.

Still other embodiments are within the scope of the claims.

What is claimed is:

1. A bookbinding method, comprising:

binding two or more sheets into a text body having an exposed spine bounded by two exposed side hinge areas;

applying solid pressure sensitive adhesive film between a cover and the side hinge areas of the text body; and binding the cover to the side hinge areas of the text body by applying pressure to the cover.

2. The bookbinding method of claim 1, wherein the solid pressure sensitive adhesive film is applied to the cover before contacting the side hinge areas of the text body.

3. The bookbinding method of claim 2, wherein the solid pressure sensitive adhesive film is applied to the cover as two strips spaced apart by a width dimension that is at least as wide as the exposed spine of the text body.

4. The bookbinding method of claim 1, further comprising applying the solid pressure sensitive adhesive film between the cover and the exposed spine of the text body, and binding the cover to the spine of the text body by applying pressure to the cover.

5. The bookbinding method of claim 4, wherein the solid pressure sensitive adhesive film is applied as a single continuous strip with a width dimension that is wider than the exposed spine of the text body.

6. The book binding method of claim 4, wherein the solid pressure sensitive adhesive film is applied in a series of multiple strips over an area corresponding to the side hinge areas and the exposed spine of the text body.

7. The bookbinding method of claim 1, wherein the solid pressure sensitive adhesive film comprises a pressure sensitive adhesive composition laminated to a hot melt adhesive film.

8. The bookbinding method of claim 7, wherein:

binding two or more sheets to the text body comprises:

applying the solid pressure sensitive adhesive film with the hot melt adhesive film in contact with the side hinge areas and the exposed spine of the text body; and melting the hot melt adhesive film to bind the two or more sheets into the text body; and binding the cover to the side hinge areas of the text body comprises disposing the cover over the text body and applying pressure to the cover to activate the pressure sensitive adhesive composition.

9. The bookbinding method of claim 1, wherein binding the cover to the side hinge areas of the text body comprises contacting the side hinge areas to the applied solid pressure sensitive adhesive film.

10. The bookbinding method of claim 1, wherein applying the solid pressure sensitive adhesive film comprises dispensing the solid pressure sensitive adhesive from a roll of solid sheet adhesive.

11. The bookbinding method of claim 10, wherein the solid sheet adhesive comprises a pressure sensitive adhesive composition dispersed on a carrier ribbon.

12. The bookbinding method of claim 11, wherein applying the solid pressure sensitive adhesive film comprises releasing a film of pressure sensitive adhesive from the carrier ribbon and reeling-in spent carrier ribbon.

13. A bookbinding method, comprising:

collecting two or more sheets into a text body having an exposed spine bounded by two exposed side hinge areas;

applying to the text body an adhesive sheet comprising a hot melt adhesive film and a backing, with the hot melt adhesive film in contact with the side hinge areas and the spine of the text body;

exposing the hot melt adhesive in areas corresponding to the side hinge areas of the text body while leaving portions of the adhesive sheet disposed over the text body spine substantially unchanged;

disposing a cover over the text body; and after the cover is disposed over the text body, melting the hot melt adhesive to bind the two or more sheets at the text body spine and to bind the cover to the side hinge areas of the text body.

14. A bookbinding method, comprising:

collecting two or more sheets into a text body having an exposed spine bounded by two exposed side hinge areas;

applying to the text body an adhesive sheet comprising a hot melt adhesive film and a backing, with the hot melt adhesive film in contact with the side hinge areas and the spine of the text body, wherein the backing includes one or more slits;

exposing the hot melt adhesive in areas corresponding to the side hinge areas of the text body by stretching the backing in the side hinge areas to expose the hot melt adhesive through the slits;

disposing a cover over the text body; and melting the hot melt adhesive to bind the two or more sheets at the text body spine and to bind the cover to the side hinge areas of the text body.

15. The bookbinding method of claim 14, wherein the slits extend in a substantially longitudinal direction and are configured to expose the hot melt adhesive upon stretching of the backing in a direction substantially orthogonal to the longitudinal direction.

16. The bookbinding method of claim 15, wherein the backing comprises a staggered array of slits.

17. A bookbinding method, comprising:

collecting two or more sheets into a text body having an exposed spine bounded by two exposed side hinge areas;

applying to the text body an adhesive sheet comprising a hot melt adhesive film and a backing, with the hot melt adhesive film in contact with the side hinge areas and the spine of the text body;

exposing the hot melt adhesive in areas corresponding to the side hinge areas of the text body by removing the backing in areas corresponding to the side hinge areas of the text body;

disposing a cover over the text body; and melting the hot melt adhesive to bind the two or more sheets at the text body spine and to bind the cover to the side hinge areas of the text body.

18. A bookbinding method, comprising:

collecting two or more sheets into a text body having an exposed spine bounded by two exposed side hinge areas;

applying to the text body an adhesive sheet comprising a hot melt adhesive film and a backing, with the hot melt adhesive film in contact with the side hinge areas and the spine of the text body;

exposing the hot melt adhesive in areas corresponding to the side hinge areas of the text body, wherein exposing the hot melt adhesive comprises folding edges of the adhesive sheet back over the adhesive sheet applied adjacent to at least a portion of each of the side hinge areas;

disposing a cover over the text body; and melting the hot melt adhesive to bind the two or more sheets at the text body spine and to bind the cover to the folded-over edges of the adhesive sheet adjacent to side hinge areas of the text body.

* * * * *